United States Patent [19]

Iannarelli

[11] Patent Number: 4,631,885

[45] Date of Patent: Dec. 30, 1986

[54] INSULATED CONCRETE MASONRY UNIT

[76] Inventor: Anthony N. Iannarelli, 345 N. Washington St., Belchertown, Mass. 01007

[21] Appl. No.: 816,334

[22] Filed: Jan. 6, 1986

[51] Int. Cl.[4] ..... E04B 2/00

[52] U.S. Cl. ..... 52/405; 52/309.12; 52/98

[58] Field of Search ..... 52/405–407, 52/309.9, 404, 98–100, 606, 607, 309.12

[56] References Cited

U.S. PATENT DOCUMENTS

| | | | |
|---|---|---|---|
| 2,852,934 | 9/1958 | Amundson | 52/405 |
| 3,885,363 | 5/1975 | Whittey | 52/405 X |
| 4,027,445 | 6/1977 | Nickerson | 52/405 |
| 4,058,948 | 11/1977 | Warren | 52/404 X |
| 4,193,241 | 3/1980 | Jensen et al. | 52/405 |
| 4,269,013 | 5/1981 | West | 52/407 X |
| 4,348,845 | 9/1982 | Iannarelli | 52/405 |

*Primary Examiner*—J. Karl Bell

*Attorney, Agent, or Firm*—Ross, Ross & Flavin

[57] ABSTRACT

A masonry block having through cavities therein of varying dimensions and a compressible, frangible insulating liner for insertion into such a cavity and having resilient arms with integral ribs adapted to bear against at least a pair of the walls of the cavity.

2 Claims, 12 Drawing Figures

30

INSULATED CONCRETE MASONRY UNIT

BACKGROUND OF THE INVENTION

Present day concerns relative to energy conservation have dictated the development of improved techniques for incorporating integral thermal insulation in buildings and other structures of single width masonry walls formed from masonry blocks having cores or cavities therein.

SUMMARY OF THE INVENTION

The primary object of the invention is the provision of a masonry block in combination with a universal compressible and frangible insulating liner adapted for insertion into a block core or cavity of various dimensions, thus obviating the necessity for molding a different insert for each type and size of core or cavity.

DESCRIPTION OF THE PREFERRED EMBODIMENTS

Directional and/or geometrical terms such as "front," "rear," "top," "bottom," "side," "longitudinal," "transverse," "horizontal," "vertical," are used hereinbelow but it is to be understood that such terminology is employed merely for convenience of description and is not to be regarded in any way as limiting the invention in the specification or claims.

Figure 1:
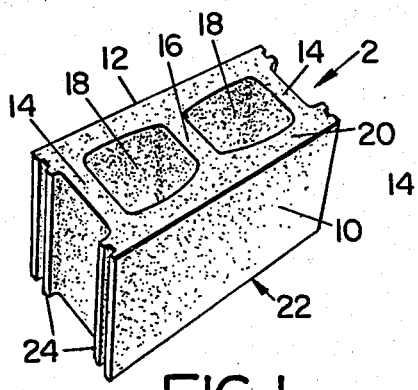
FIGS. 1–3 are perspective views of concrete masonry blocks of the type with which the insulating liner of the invention is used.
Figure 2:
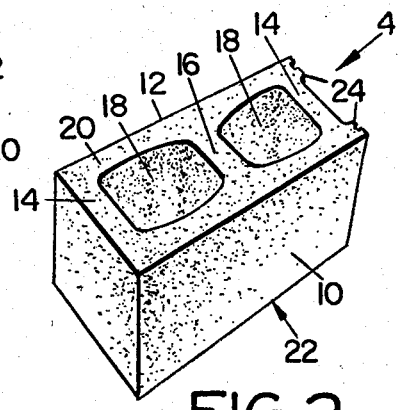
Figure 3:
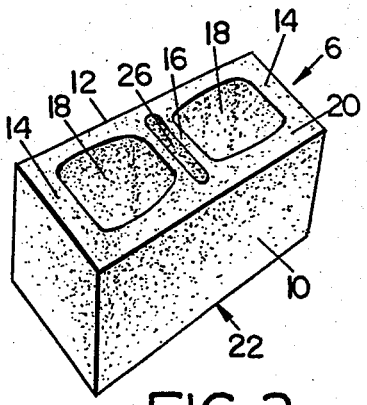
Figure 7:
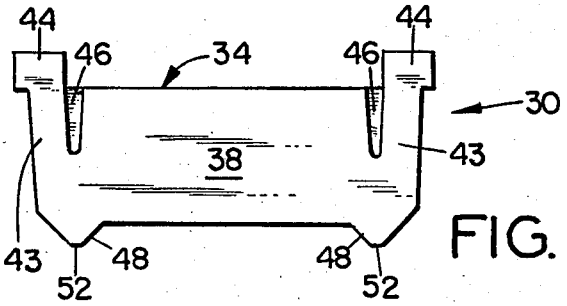
FIGS. 4, 5, 6 and 7 are front elevational, side elevational, rear elevational, and top plan views respectively of the insulating liner.
Figure 4:
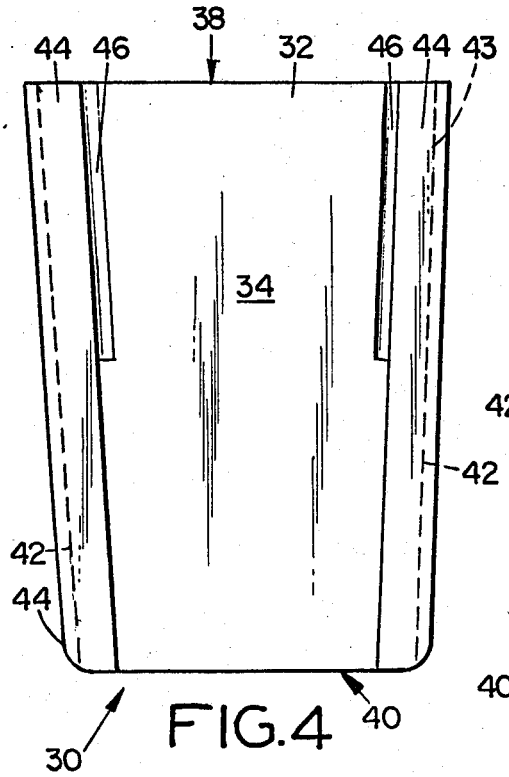
Figure 5:
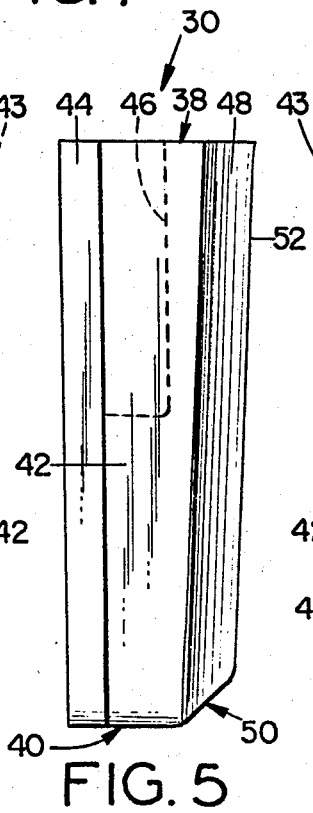
Figure 6:
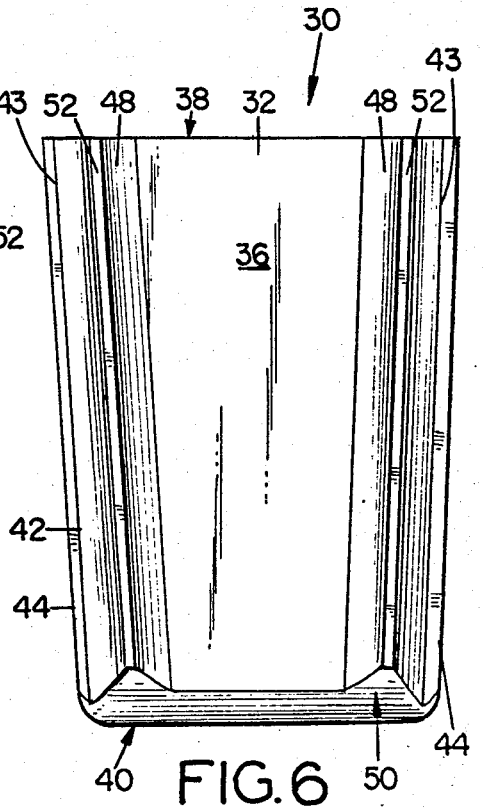

I have shown, in FIGS. 1–3, building blocks 2, 4 and 6 respectively, constructed in accordance with the spirit of the invention. Same may be made of concrete or other cementitious material and are defined as being of generally rectangular blocklike configuration having the nominal dimensions of 8″ in height, 8″ in width and 16″ in length.

Each block has a vertical exterior front face shell 10, a vertical interior rear face shell 12 spaced therefrom, vertical end webs 14, 14 adjacent opposite ends and a vertical intermediate web 16 interconnecting between the inboard sides of front and rear face shells 10 and 12, all as a unitary structure defining a pair of spaced air cells or cores or cavities 18 each extending throughout the vertical dimension of the block from the upper planar face 20 to the lower planar face 22 thereof.

Block 2 includes spaced, vertical end flanges 24 which extend outwardly from end webs 14 at front and rear face shells 10 and 12 at each end of the block.

In block 4, spaced, vertical end flanges 24 are provided at only one end of the block and extend outwardly from end web 14, the other end of the block being flat and plain throughout.

In the case of block 6, no end flanges are provided, both ends being flat and plain throughout.

A centrally-disposed vertical through slot 26 is provided in intermediate web 16 to simplify the matter of cutting the block into half segments.

Figure 9:
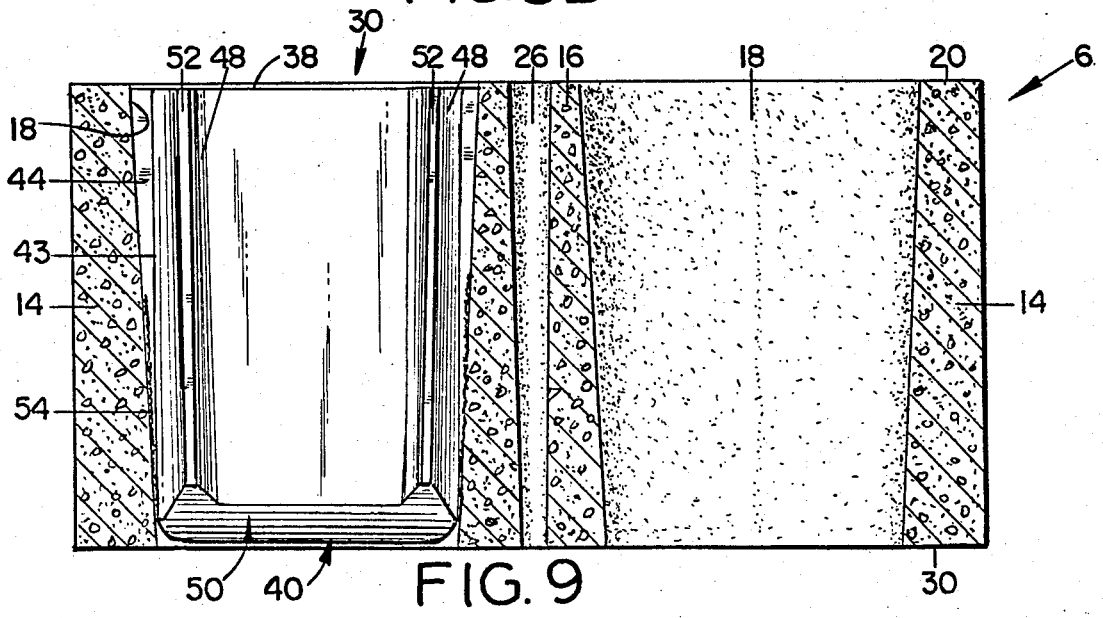
FIG. 9 is a cross-sectional view taken on line 9—9 of FIG. 8B, with one of the insulating liners removed for clarity.

As best seen in FIG. 9, the walls of air cells or cavities 18 taper gradually vertically inwardly from upper planar face 20 to lower planar face 22 in order to provide for the easy removal of the molding core, not shown, during block manufacture.

The cores employed in molding the blocks may vary somewhat in dimension, especially as wear ensues through continued use, the result being that the cross sectional cavity configurations and/or dimensions will be subject to variation over a modest range, the variations occurring from block to block, or conceivably even from cavity to cavity in a single block.

The insulating liner of the invention is of such configurations and dimensions as to accommodate to these variations.

Having particular reference to FIGS. 4–7 and 10, there is shown an insulating liner 30 for use with the building blocks of FIGS. 1–3 and preferentially formed of a lightweight, frangible, compressible, foraminous, heat insulating, and fire retardant material whereby a fire stop function and a reasonable degree of resistance to sound and moisture transmission are provided. Molded expanded polystyrene has been found to be a particularly desirable material for the purpose.

Liner 30 is generally wedge shaped in vertical elevation, having side walls which taper inwardly from top to bottom, with the taper generally conforming to the inward taper of the walls of cavities 18 of blocks 2, 4 and 6.

The liner includes a vertically-extending central wall 32 having spaced front and rear faces 34 and 36 respectively which terminate at their opposite ends in flat, parallel upper and lower faces 38 and 40 respectively.

Rear face 36 tapers inwardly toward front face 34 from top to bottom.

Central wall 32 has spaced side walls 42 which extend between upper face 38 and lower face 40 and taper inwardly toward each other from top to bottom.

Each side wall 42 is provided through its entire length with an integral vertical rib 44 which projects outwardly therefrom.

Ribs 44 also extend forwardly and outwardly from each side wall 42 beyond the plane of front face 34 of central wall 32.

The opposite sides of central wall 32 are cut away to provide a pair of spaced, vertical, tapered notches 46 which extend horizontally inwardly from front face 34 approximately one-half the thickness of the central wall and extend vertically downwardly from upper face 38 approximately one-half the length of the central wall. The notches 46 are disposed inwardly of each side wall 42 thereby defining resilient arms 43 at each side of the liner in the upper portion thereof.

Slots 46 allow the compression of arms 43 inwardly toward central wall 32. Since the slots extend only through one-half the length of the liner, the insulating capacities of the liner are not adversely affected.

The longitudinal or horizontal dimension of the liner from the outer face of one rib 44 to the outer face of the other rib 44 is substantially the same as the corresponding longitudinal or horizontal dimension of cavities 18 in blocks 2, 4 and 6.

The vertical dimension of the liner between upper face 38 and lower face 40 is substantially the same as the corresponding vertical dimension of cavities 18 in blocks 2, 4 and 6.

Spaced projections 48 extend rearwardly from rear face 36 of central wall 32 adjacent and along the entire length of each side edge thereof, the projections tapering inwardly toward each other from top to bottom.

Projections 48 are generally triangulate in plan and merge with the lower face 40 of central wall 32.

The lower ends of projections 48 and the rear edge of the lower face 40 of wall 32 are chamferred as at 50 for facilitating the insertion of liner 30 into block cavities 18.

The apex of each projection 48 is flattened as at 52 to provide better bearing surfaces with the walls of block cavities 18, while the projections serve to preclude the liner from touching the block surface. Thus I provide an increase in the thermal resistance value of the block. Furthermore, I also provide a means for allowing any moisture penetrating that surface to harmlessly evaporate.

In use, the lower end 40 of liner 30 is inserted into block cavity 18 and is forced into the cavity with the outer faces or ribs 44 bearing against the inner end walls of the cavity.

Figure 8A:
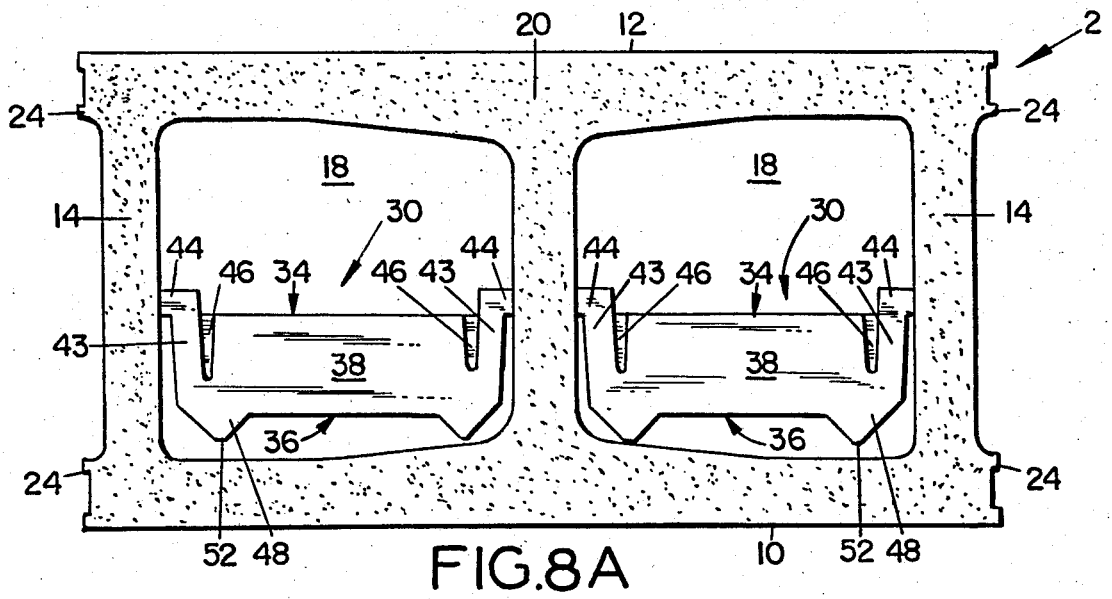
FIG. 8A is a top plan view of the FIG. 1 concrete masonry block with the insulating liners of FIGS. 4–7 disposed in the cavities thereof.
Figure 8B:
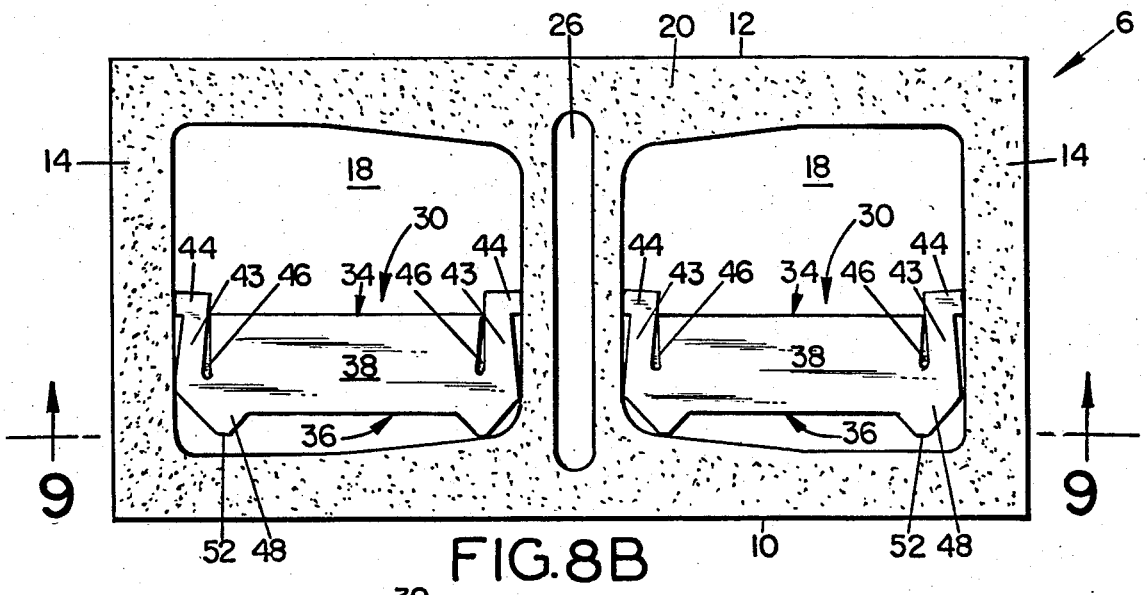
FIG. 8B is a top plan view of the FIG. 3 concrete masonry block with the insulating liners of FIGS. 4–7 disposed in the cavities thereof.

Depending upon the dimensions of the cavity, the outer surfaces of ribs 44 either bear lightly against cavity inner end walls, as in FIG. 8A, or bear tightly thereagainst as in FIG. 8B, with arms 43 being compressed and flexed inwardly toward liner central wall 32 at notches 46.

Figure 10:
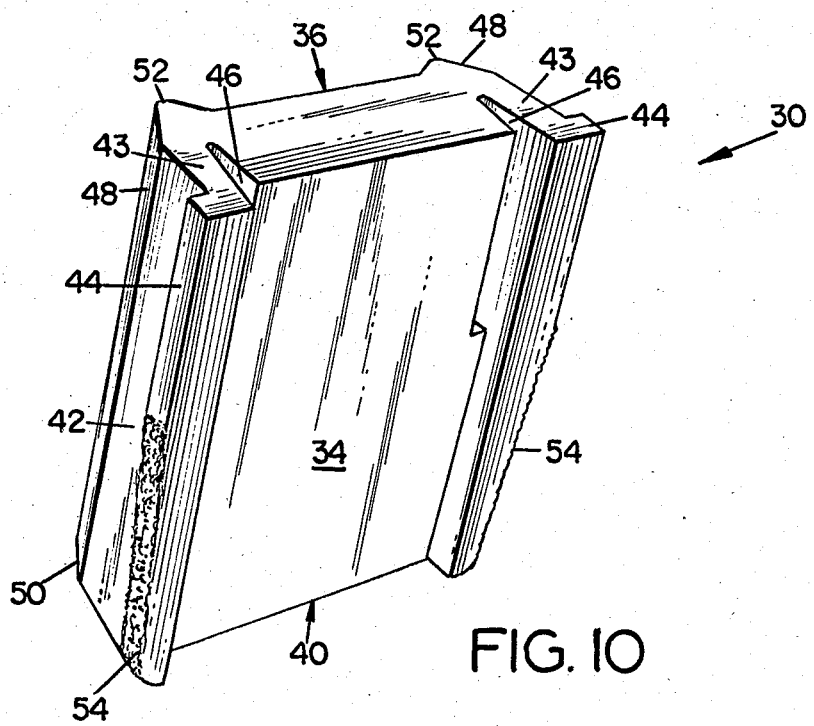
FIG. 10 is a front perspective view of an insulating liner showing how portions thereof are broken away following its insertion into the cavity of a masonry block.

Since the material of the liner is readily frangible, in the event that the longitudinal, horizontal dimension of the liner is considerably greater than that of cavity 18, portions of the outer faces of ribs 44 become broken away as at 54 in FIGS. 9 and 10 when the liner is forced downwardly into the cavity.

The flattened areas 52 of the liner ribs 48 may or may not bear against the adjacent inner wall of block cavity 18 as shown in FIGS. 8A and 8B, again depending upon the relative dimensions of the block cavity and liner and the particular positioning of the liner in the cavity relative to the longitudinal center line of the block.

Figure 11:
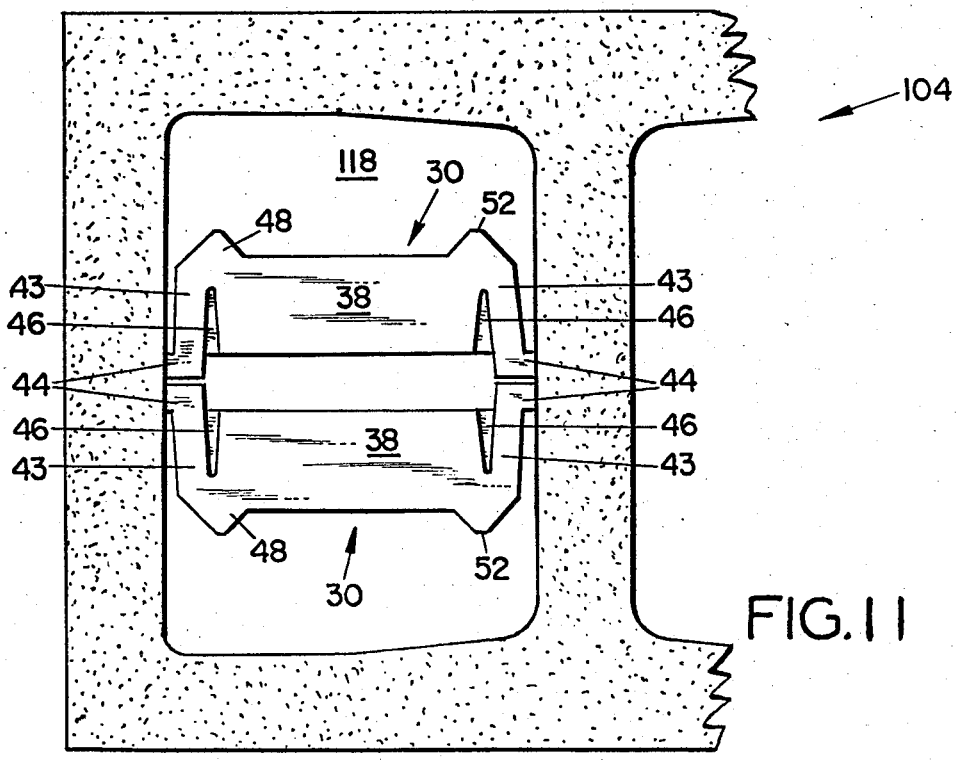
FIG. 11 is a fragmentary top plan view of a larger sized concrete masonry block, (12″×8″×16″) and having a pair of the insulating liners of FIGS. 4–7 disposed in one of the cavities thereof in a face-to-face relationship with each other.

In FIG. 11, a pair of liners 30 is shown in face-to-face relation in cavity 118 of a block 104, with the ribs 44 of the liners bearing against the adjacent cavity walls.

Block 104 is similar to the blocks of FIGS. 1–3 in material and configuration, except that it will have a greater width of either 10″ or 12″ as opposed to the 8″ width of blocks 2, 4 and 6, thus providing a cavity 118 of greater width to accommodate a pair of liners 30 therein.

The other dimensions of block 104 are the same as those of blocks 2, 4 and 6.

That is, 8″ in height and 16″ in length.

In this instance, the combined transverse horizontal dimension of the pair of liners is substantially less than that of cavity 118 so that none of the projections 48 contact the adjacent cavity walls thereby defining dead air spaces for increasing the resistance of the block. Dead air in these spaces is the desideratum, not moving air.

I claim:

1. In combination with a masonry block having cavities therein of varying longitudinal and transverse cross sectional dimensions, an insulating liner formed from a frangible and compressible material and being insertable into a block cavity, the liner having a longitudinal cross sectional dimension substantially equal to that of the block cavity and a transverse cross sectional dimension substantially less than that of the block cavity and having a central body with substantially parallel vertically-extending front and rear planar faces and side faces, each side of the liner adjacent the side face being provided with a vertically-extending L-shaped rib projecting at each end of the central body forwardly and outboard of the plane of the liner front face and then transversely outwardly and away from its outer end for embracing and being crushable upon any contact with a respective adjacent wall of the block cavity, a vertically-extending notch extending into the liner inwardly a short distance from the liner front face in the region of the upper portion of the liner between each rib and the central liner body for permitting a yielding deflection of the rib upon contact with a respective adjacent wall of the block cavity, a pair of spaced vertically-extending outwardly-projecting projections on the liner rear face for bearing against a respective adjacent wall of the block cavity and allowing definition of an air space between the liner and said respective adjacent wall.

2. In the combination according to claim 1, wherein a pair of liners is disposed in each block cavity in a face-to-face relationship.

* * * * *